US009018552B2

(12) United States Patent
Lin et al.

(10) Patent No.: US 9,018,552 B2
(45) Date of Patent: Apr. 28, 2015

(54) ELECTRICAL CONTACT INCLUDING STAINLESS STEEL MATERIAL

(71) Applicant: Taiwan Electric Contacts Corp., New Taipei (TW)

(72) Inventors: Ming-Chang Lin, New Taipei (TW); Da-Pon Han, New Taipei (TW)

(73) Assignee: Taiwan Electric Contacts Corp., New Taipei (TW)

( * ) Notice: Subject to any disclaimer, the term of this patent is extended or adjusted under 35 U.S.C. 154(b) by 365 days.

(21) Appl. No.: 13/667,714

(22) Filed: Nov. 2, 2012

(65) Prior Publication Data

US 2013/0112533 A1 May 9, 2013

(30) Foreign Application Priority Data

Nov. 4, 2011 (TW) ..... 100140217 A
Nov. 4, 2011 (TW) ..... 100140219 A

(51) Int. Cl.
*H01H 1/02* (2006.01)
*H01H 1/023* (2006.01)

(52) U.S. Cl.
CPC *H01H 1/023* (2013.01); *H01H 1/02* (2013.01)

(58) Field of Classification Search
CPC ..... H01H 1/00; H01H 1/02; H01H 1/0206; H01H 1/021; H01H 1/023; H01H 2100/00; H01H 2001/021; H01H 2001/023; H01H 2201/00; H01H 2201/022; H01H 2201/024; H01H 2201/026; H01H 2201/03; G11B 5/708; G11B 5/66; B22D 3/00; B22D 5/00; B22D 7/00; B22D 9/00; B22D 11/00; B22D 11/06; B22D 21/00; B22D 23/00; B22D 25/00; H01F 1/16; H01F 3/00; B23K 20/233; D07B 1/06; B21C 37/00; B32B 15/18; B32B 15/00; B32B 27/00; C25D 5/10; C22C 1/0466; C22C 5/06
USPC ..... 200/265; 428/842.7, 832.2, 544, 590, 428/592, 638, 684, 685, 340; 427/673; 252/500
See application file for complete search history.

(56) References Cited

U.S. PATENT DOCUMENTS 5,087,414 A * 2/1992 Maniar ..... 420/43
2010/0187084 A1 * 7/2010 Suzuki et al. ..... 200/520

* cited by examiner

*Primary Examiner* — Renee S Luebke
*Assistant Examiner* — Anthony R. Jimenez
(74) *Attorney, Agent, or Firm* — Muncy, Geissler, Olds & Lowe, P.C.

(57) ABSTRACT

An electrical contact including stainless steel material is disclosed with advantages of good fusing resistance, good abrasion resistance and low contact electrical resistance. The electrical contact includes silver-based material and the stainless steel material. The stainless steel material is dispersed in the silver-based material and weight percentage thereof accounting to the electrical contact is 0.01% to 35%.

8 Claims, 6 Drawing Sheets

| | Number | Composition (wt%) | | | | | | |
|---|---|---|---|---|---|---|---|---|
| | | Ag | AISI 304L | AISI 316L | AISI 630 | Ni | Fe | form |
| Embodiments | 1.1 | 99.99 | 0.01 | - | - | - | - | Tip form |
| | 1.2 | 99.9 | 0.1 | - | - | - | - | Tip form |
| | 1.3 | 90 | 10 | - | - | - | - | Tip form |
| | 1.4 | 90 | - | 10 | - | - | - | Tip form |
| | 1.5 | 90 | - | - | 10 | - | - | Tip form |
| | 1.6 | 90 | 5 | 5 | - | - | - | Tip form |
| | 1.7 | 85 | - | 15 | - | - | - | Tip form |
| | 1.8 | 70 | - | 30 | - | - | - | Tip form |
| | 1.9 | 90 | - | 10 | - | - | - | Rivet form |
| Comparative embodiments | 1.1 | 100 | - | - | - | - | - | Tip form |
| | 1.2 | 90 | - | - | - | 10 | - | Tip form |
| | 1.3 | 90 | - | - | - | - | 10 | Tip form |
| | 1.4 | 85 | - | - | - | 15 | - | Tip form |
| | 1.5 | 70 | - | - | - | 30 | - | Tip form |
| | 1.6 | - | 100 | - | - | - | - | Tip form |
| | 1.7 | 90 | - | - | - | 10 | - | Rivet form |

FIG. 1

| | Number | Density ( $g/cm^3$ ) | Electrical life ( times ) |
|---|---|---|---|
| Embodiments | 1.1 | 10.13 | 17,418 |
| | 1.2 | 9.89 | 21,535 |
| | 1.3 | 9.92 | 26,227 |
| | 1.4 | 9.93 | 29,521 |
| | 1.5 | 9.87 | 29,257 |
| | 1.6 | 9.89 | 27,822 |
| | 1.7 | 9.86 | 34,558 |
| | 1.8 | 9.51 | 20,537 |
| | 1.9 | 9.97 | 33,329 |
| Comparative embodiments | 1.1 | 9.93 | 11,978 |
| | 1.2 | 9.90 | 16,404 |
| | 1.3 | 9.79 | 25,001 |
| | 1.4 | 9.89 | 25,604 |
| | 1.5 | 9.70 | 19,047 |
| | 1.6 | 7.96 | 249 |
| | 1.7 | 10.20 | 4,232 |

FIG. 2

| | Number | Composition (wt%) | | | | | | |
|---|---|---|---|---|---|---|---|---|
| | | Ag | AISI 304L | AISI 316L | AISI 630 | Ni | Fe | form |
| Embodiments | 2.1 | 90 | 0.01 | - | - | 9.99 | - | Tip form |
| | 2.2 | 90 | 0.1 | - | - | 9.9 | - | Tip form |
| | 2.3 | 90 | 9.99 | - | - | 0.01 | - | Tip form |
| | 2.4 | 90 | - | 9 | - | 1 | - | Tip form |
| | 2.5 | 90 | - | 7.5 | - | 2.5 | - | Tip form |
| | 2.6 | 90 | - | 6.25 | - | 3.75 | - | Tip form |
| | 2.7 | 90 | - | 5 | - | 5 | - | Tip form |
| | 2.8 | 90 | - | 3.75 | - | 6.25 | - | Tip form |
| | 2.9 | 90 | - | 2.5 | - | 7.5 | - | Tip form |
| | 2.10 | 85 | - | 10 | - | 5 | - | Tip form |
| | 2.11 | 85 | - | 5 | - | 10 | - | Tip form |
| | 2.12 | 70 | - | 22.5 | - | 7.5 | - | Tip form |
| | 2.13 | 90 | - | 0.1 | - | 9.9 | | Rivet form |
| | 2.14 | 90 | - | 2.5 | - | 7.5 | - | Rivet form |
| Comparative embodiments | 2.1 | 100 | - | - | - | - | - | Tip form |
| | 2.2 | 90 | - | - | - | 10 | - | Tip form |
| | 2.3 | 90 | - | - | - | 5 | 5 | Tip form |
| | 2.4 | 85 | - | - | - | 15 | - | Tip form |
| | 2.5 | 70 | - | - | - | 30 | - | Tip form |
| | 2.6 | - | 100 | - | - | - | - | Tip form |
| | 2.7 | 90 | - | - | - | 10 | - | Rivet form |

FIG. 3

| | Number | Density ( g/cm$^3$ ) | Electrical life ( times ) |
|---|---|---|---|
| Embodiments | 2.1 | 10.10 | 18,212 |
| | 2.2 | 10.15 | 21,003 |
| | 2.3 | 9.88 | 28,784 |
| | 2.4 | 9.83 | 28,273 |
| | 2.5 | 9.89 | 25,510 |
| | 2.6 | 10.06 | 26,313 |
| | 2.7 | 10.00 | 26,026 |
| | 2.8 | 10.03 | 24,201 |
| | 2.9 | 10.02 | 27,583 |
| | 2.10 | 9.84 | 27,221 |
| | 2.11 | 9.89 | 31,580 |
| | 2.12 | 9.30 | 21,940 |
| | 2.13 | 10.20 | 21,113 |
| | 2.14 | 10.13 | 23,860 |
| Comparative embodiments | 2.1 | 9.93 | 11,978 |
| | 2.2 | 9.90 | 16,404 |
| | 2.3 | 9.85 | 9,890 |
| | 2.4 | 9.89 | 25,604 |
| | 2.5 | 9.70 | 19,047 |
| | 2.6 | 7.96 | 249 |
| | 2.7 | 10.20 | 4,232 |

FIG. 4

| | Number | Composition (wt%) | | | | | Temperature rising (℃) |
|---|---|---|---|---|---|---|---|
| | | Ag | AISI 304L | AISI 316L | Ni | from | |
| Embodiments | 2.15 | 90 | 0.01 | - | 9.99 | Tip form | 26.00 |
| | 2.16 | 90 | 9.99 | - | 0.01 | Tip form | 40.50 |
| | 2.17 | 90 | - | 7.5 | 2.5 | Tip form | 31.23 |
| | 2.18 | 90 | - | 5 | 5 | Tip form | 31.73 |
| | 2.19 | 85 | - | 5 | 10 | Tip form | 37.20 |
| | 2.20 | 90 | - | 0.1 | 9.9 | Rivet form | 32.30 |
| | 2.21 | 90 | - | 2.5 | 7.5 | Rivet form | 32.55 |
| Comparative embodiments | 2.8 | 99.99 | 0.01 | - | - | Tip form | 28.95 |
| | 2.9 | 90 | 10 | - | - | Tip form | 43.03 |
| | 2.10 | 85 | - | 15 | - | Tip form | 49.23 |
| | 2.11 | 90 | - | 10 | - | Rivet form | 35.73 |

FIG. 5

ELECTRICAL CONTACT INCLUDING STAINLESS STEEL MATERIAL

BACKGROUND OF INVENTION

1. Field of Invention

The present invention relates to an electrical contact, more particularly, to an electrical contact having good fusing resistance, good abrasion resistance and low contact resistance.

2. Related Prior Art

An electrical contact is an important component used in various switches in daily life. The selection of materials of the electrical contact is critical as it has direct influence on the electrical life and reliability of the switch having the electrical contact. The following are common materials of the electrical contact currently used in the market.

AgCdO has good temperature rising property, and is both abrasion resistant and fusing resistant, but Cadmium therein is a toxic material which has now been replaced by other environmental protective contact materials.

$AgSnO_2$ has good fusing resistance. However, it has high contact resistance and therefore is hard to be produced.

AgZnO has advantages of short arc time and high thermal stability under medium-low loading condition, but the extensibility and formability thereof is poor and hard to be produced.

AgW has good fusing resistance, but has problem of high contact resistance under non-protective atmosphere.

AgNi is applied to low-voltage switch and has advantages of low contact resistance and easily welded, but fusing resistance ability thereof is poor.

AgFe has advantageous characteristics as good arc-proof and fusing resistance, but AgFe will form iron oxide under high temperature and the iron oxide will deposit on surface thereof and results in a sudden deterioration of the temperature rise, thus the operation of the switch used an electrical contact made of AgFe will be affected.

Stainless steel is an alloy of chromium and nickel materials such that an electrical contact made by the stainless steel has advantages of good corrosion resistance and good wear resistance. However, compare to an electrical contact including silver-based material, the stainless steel electrical contact has the disadvantage of high contact resistance.

An electrical contact having multi-layer structure is disclosed in U.S. Pat. No. 7,015,406. The electrical contact has a main body made of copper or stainless steel, a middle layer made of silver or nickel and disposed on the main body, and a contact layer made of platinum group metal and disposed on the middle layer.

Another electrical contact is disclosed in Japan Pat. 2007-138237A. The electrical contact includes a stainless steel body having a surface which is coated with a silver layer by electroplating process. In more detail, before electroplating the silver layer to the stainless steel body, the stainless steel body must be previously coated a nickel layer with thickness from 0.01 to 0.1 μm and a copper or copper alloy layer with thickness from 0.05 to 0.2 μm, and then subjected the two layers to activation treatment in order to improve the bonding strength between the stainless steel body and the silver surface layer. However, the stainless steel body still has problems of poor processability and high contact resistance, and not suitable to be applied to a switch under low or middle loading conditions.

SUMMARY OF INVENTION

It is an objective of the present invention to provide an electrical contact which can be applied to various switches, relays and breakers. The electrical contact has good fusing resistance, good abrasion resistance, low contact resistance and high chemical stability, and thus the electrical contact can avoid performance deterioration caused by prolonged operation of the switch.

The electrical contact of the present invention is made of a composite material which comprises a silver-based material and a stainless steel material. The stainless steel material is dispersed in the silver-based material and the weight percentage thereof accounting to the electrical contact is 0.01% to 35%.

Preferably, the composite material of the electrical contact further comprises a nickel material, and both of the stainless steel and nickel materials are dispersed in the silver-based material. The weight percentage of the nickel material and the stainless steel material in the electrical contact are respectively from 0.01% to 35%.

Preferably, the weight percentage of the stainless steel material in the electrical contact is from 0.01% to 30%.

Preferably, the stainless steel material is selected from one of the group consisting of ferrite, austenite, martensite and any combination thereof.

Compare to the prior art, the electrical contact of the present invention is made by the composite material which includes at least one kind of the stainless steel material and further includes the silver-based material and the nickel material. Thus, the electrical contact of the present invention is able to achieve excellent performances. Specifically, the silver-based material is mainly used as a conductive material and has well heat dissipating ability. The stainless steel material is used as an enhancing material and provides good fusing resistance, good abrasion resistance and excellent chemical stability. The nickel material provides wetting function between the silver-based material and the stainless steel material to make the electrical contact of the present invention having lower contact resistance, and thus extending the life time of the electrical contact of the present invention.

Other objectives, advantages and features of the present invention will be apparent from the following description referring to the attached drawings.

BRIEF DESCRIPTION OF DRAWINGS

The invention is illustrated by the accompanying drawings in which corresponding parts are identified by the same numerals and in which:

FIG. 1 shows the composition of an electrical contact of a plural embodiments of the present invention and a plural comparative embodiments;

FIG. 2 shows test results of the embodiments and the comparative embodiments of FIG. 1;

FIG. 3 shows the composition of electrical contact of another embodiments of the present invention and a plural comparative embodiments;

FIG. 4 shows test results of the embodiments and the comparative embodiments of FIG. 3;

FIG. 5 shows the composition of an electrical contact of a plural embodiments of the present invention and a plural comparative embodiments, and test results of temperature rise test;

DETAILED DESCRIPTION OF THE PREFERRED EMBODIMENT

Figure 6:
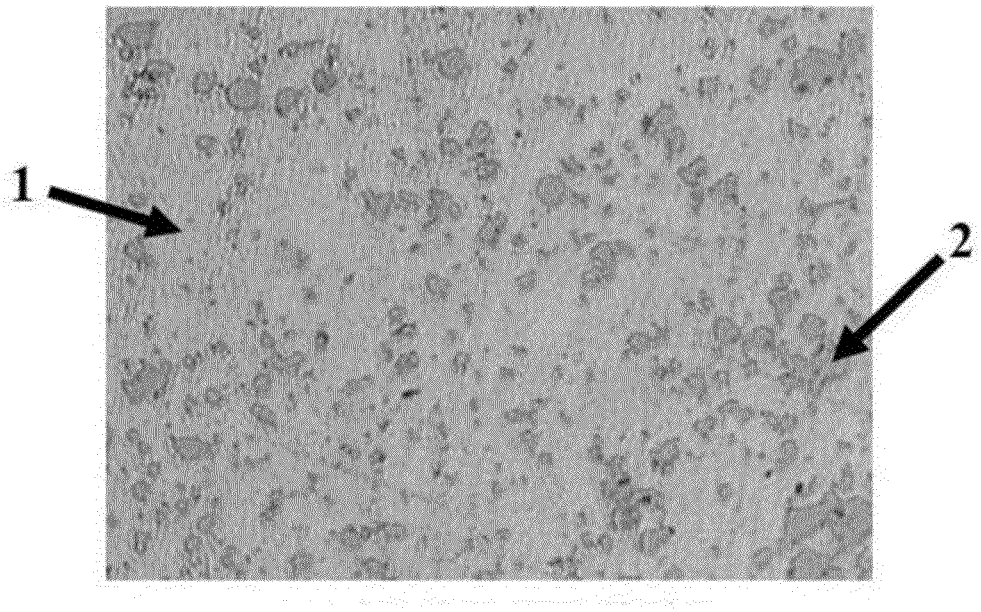
FIG. 6 shows a metallographic structure (magnification: 100×) of a composite material of the electrical contact of the present invention, wherein the composite material includes a silver-based material and a stainless steel material.

Referring to FIG. 1, the electrical contacts of embodiments 1.1 to 1.6 are respectively made of a composite material including a silver-based material and a stainless steel material with different weight percentages thereof. And, the stainless steel material is evenly dispersed in the silver-based material.

The manufacturing process of the electrical contact of the present invention is described as follow. Firstly, silver powder and stainless steel powder with average particle diameter both below 106 μm are mixed according to weight percentages as shown in FIG. 1. The stainless steel material is selected from one of the group consisting AISI 304L, AISI 316L, AISI 630 stainless steel powder and any mixing powder thereof. Then, the mixing powder of silver and stainless steel is put under 15 ton/cm$^2$ pressure and therefore forming an embryonic body. And, the embryonic body is sintered under dissociated ammonia reducing atmosphere with 850° C. temperature for an hour to make the electrical contact with tip form.

Moreover, after getting these electrical contacts of embodiments 1.1 to 1.6, the electrical contacts are put into an electrical contact test machine for testing. The testing is processed under AC110V, rated current 30 A, contact force between contacts 150 g and separating force 150 g conditions. And, electrical and mechanical properties, such as density and electrical life of the electrical contacts, are observed by various testing equipments, the testing results are shown in FIG. 2.

The electrical contacts of embodiments 1.1 and 1.2 are both formed by silver powder and AISI 304L stainless steel powder, the only difference there between is the mixing ratio thereof. Specifically, the weight percentage of the stainless steel of embodiment 1.1 is 0.01% and that of the embodiment 1.2 is 0.1%. As testing results shown in FIG. 2, electrical life of the electrical contacts of embodiments 1.1 and 1.2 are 17,418 times and 21,535 times. Accordingly, electrical life of the electrical contact of embodiment 1.2 is enhanced by 24% in comparison with that of embodiment 1.1. Thus, it can be seen that within a certain range, increasing the mixing ratio of the stainless steel material in the composite material of the electrical contacts can improve electrical life of the electrical contact.

The electrical contacts of embodiments 1.3 to 1.6 are all formed by 90 wt % silver powder and 10 wt % stainless steel powder. And, the stainless steel powder is selected from one of the group consisting of AISI 304L, AISI 316L, AISI 630 stainless steel powder and any combination thereof. As testing results shown in FIG. 2, electrical life of the electrical contacts of embodiments 1.3 to 1.6 are 26,227 times, 29,521 times, 29,257 times and 27,822 times. Electrical life of the electrical contact of embodiment 1.4 is highest thereof and is enhanced by 69% compare to that of embodiment 1.1. Furthermore, electrical life of the electrical contact of embodiment 1.4 is enhanced by 37% in comparison with that of embodiment 1.2. Thus, it can be seen that electrical life of the electrical contact will be enhanced with the increase of the mixing ratio of the stainless steel material in the composite material of the electrical contact within a certain range under 10 wt % of the stainless steel material.

Comparative embodiments 1.1, 1.2, 1.3 and 1.6 show a plural electrical contacts of the prior art. These electrical contacts is made of the group consisting silver powder, nickel powder, iron powder or combination thereof with mixing ratio shown in FIG. 1, and with the same manufacturing process of the electrical contacts of embodiment 1.1 to make pure silver, silver-nickel, silver-iron and pure stainless steel electrical contacts with tip form.

Moreover, the electrical contacts of comparative embodiments 1.1, 1.2, 1.3 and 1.6 undergo the same testing as above-mentioned under the same conditions. The testing results are shown in FIG. 2. As the testing results shown in FIG. 2, electrical life of pure silver electrical contact of comparative embodiment 1.1 and pure stainless steel electrical contact of comparative embodiment 1.6 are 11,978 times and 249 times. And, electrical life of comparative embodiments 1.2 and 1.3 which both has 90 wt % silver material are 16,404 times and 25,001 times.

In comparison, electrical life of the electrical contact of embodiment 1.1 is enhanced by 45% with respect to the electrical contact of comparative embodiment 1.1, and is enhanced by 6,895% with respect to the electrical contact of comparative embodiment 1.6. Thus, it can be seen that electrical life of the electrical contact will be enhanced with mixing 0.01 wt % stainless steel material into the composite material of electrical contact. Moreover, electrical life of electrical contact of embodiment 1.2 is enhanced by 80% with respect to the electrical contact of comparative embodiment 1.1, and is enhanced by 8,549% with respect to the electrical contact of comparative embodiment 1.6. Therefore, the electrical contact of embodiments 1.1 to 1.6 of the present invention which is made of the composite material is able to optimize the performance of enhanced electrical life.

On the other hand, comparing with the electrical contacts of embodiments 1.3 to 1.6 and comparative embodiments 1.2 and 1.3, electrical life of electrical contact of embodiment 1.4 which is the highest of embodiments 1.3 to 1.6 is enhanced by 80% with respect to the electrical contact of comparative embodiment 1.2.

Based on the above, the electrical contact of the present invention which is made of the composite material including silver-based and stainless steel materials that has better performance of electrical life and improves poor fusing resistance of the prior art.

Moreover, the above-mentioned stainless steel material is selected from one of the group consisting of AISI 304L, AISI 316L, AISI 630 and any combination thereof, and wherein the AISI 316L stainless steel material includes Molybdenum (Mo) material which has high melting point characteristic and a little amount of Carbon which has characteristic of fusing resistance and reduction, and thus the AISI 316L can improve its strength by solid solution strengthening to have better hardness and wear resistance performances. And, on the performance of mass loss, the silver-stainless steel material of the present invention is between silver-iron and silver-nickel materials, and has advantages of both. The AISI 630 stainless steel material has excellent strength under high temperature to make the electrical contact having better electrical life, improved arc resistance and improved wear resistance. Moreover, the AISI 630 stainless steel material belongs to martensite stainless steel which is able to be strengthened by heat processing, and thus the AISI 630 stainless steel material can keep its strength under high temperature operation. Although the contact resistance of the AISI 630 stainless steel material is higher than austenite stainless steel, like AISI 304L and AISI 316L, but thermal conductivity thereof is better than austenite stainless steel, and has better temperature rising performance.

Referring back to FIG. 1, the electrical contacts of embodiments 1.7 and 1.8 respectively has 15 wt % stainless steel material and 30 wt % stainless steel material. The manufacturing process is the same with the embodiment 1.1.

The electrical contacts of comparative embodiments 1.4 and 1.5 are made of silver powder and nickel powder with different mixing ratio shown in FIG. 1 under the same manufacturing process mentioned above.

The electrical contacts of embodiments 1.7, 1.8 and comparative embodiments 1.4, 1.5 are conducted the same testing under the same conditions like above-mentioned, and the testing results are shown in FIG. 2.

Both of the electrical contacts of embodiment 1.7 and comparative embodiment 1.4 have 85 wt % silver material accounting to the composite material. As testing results shown in FIG. 2, electrical life of the electrical contact of embodiment 1.7 is 34,558 times and electrical life of the electrical contact of comparative embodiment 1.4 is 25,604 times. Therefore, electrical life of the electrical contact of embodiment 1.7 is enhanced by 35% with respect to that of comparative embodiment 1.4.

And, both of the electrical contacts of embodiment 1.8 and comparative embodiment 1.5 have 70 wt % silver material accounting to the composite material. As testing results shown in FIG. 2, electrical life of the electrical contact of embodiment 1.8 is 20,537 times and electrical life of the electrical contact of comparative embodiment 1.5 is 19,047 times. Therefore, electrical life of the electrical contact of embodiment 1.8 is enhanced by 8% with respect to that of comparative embodiment 1.5.

The electrical contact of embodiment 1.9 is an electrical contact in rivet form of the present invention. The electrical contact in rivet form is also made of the composite material including silver-based material and stainless steel material, wherein the weight percentage of the stainless steel material accounting to the composite material is 10%. The manufacturing process is substantially the same with embodiment 1.1, the difference therebetween is that after the embryonic body is sintered, the sintering embryonic body is put into an extruder and is extruded to form a wire under 800° C. and pumping made with a predetermined size. And, the wire with the predetermined size is formed the rivet form electrical contact by a rivet heading machine under room temperature. The electrical contact in rivet form has head diameter of 4 mm, head thickness of 1 mm, shank diameter of 2 mm and shank length of 2.2 mm.

The electrical contact of comparative embodiment 1.7 is in rivet form made of silver powder and nickel powder with mixing ratio shown in FIG. 1 under the same manufacturing process as embodiment 1.9.

The electrical contacts of embodiment 1.9 and comparative embodiment 1.7 are conducted the same testing under the same conditions like above-mentioned, and the testing results are shown in FIG. 2. As testing results shown in FIG. 2, electrical life of the silver-stainless steel electrical contact of embodiment 1.9 is 33,329 times and electrical life of the silver-nickel electrical contact of comparative embodiment 1.7 is 4,232 times. Therefore, electrical life of the electrical contact of embodiment 1.9 is enhanced by 688% with respect to that of comparative embodiment 1.7.

Accordingly, the silver-stainless steel electrical contact of the present invention has better performances of arc resistance and chemical stability with respect to the silver-nickel electrical contact of the prior art. And the silver-stainless steel electrical contact of the present invention can further improve the disadvantages of high arc-erosion and poor fusing resistance of the silver-nickel electrical material of the prior art.

Referring to FIG. 3, another type of electrical contact is disclosed in embodiments 2.1 to 2.9. The electrical contact is made of another composite material including silver-based material, stainless steel material and nickel material. Both of the stainless steel material and the nickel material are evenly dispersed in the silver-based material, and the weight percentages thereof are shown in FIG. 3. The electrical contacts of embodiments 2.1 to 2.9 are manufactured by the same manufacturing process as embodiment 1.1.

The composition of the electrical contact of comparative embodiments 2.1, 2.2, 2.3 and 2.6 are shown in FIG. 3. These electrical contacts are in tip form and manufactured by the same manufacturing process as embodiment 1.1.

The electrical contacts of embodiments 2.1 to 2.9 and comparative embodiments 2.1, 2.2, 2.3 and 2.6 undergo the same testing under the same conditions like embodiment 1.1, and the testing results are shown in FIG. 4.

Based on the test results, electrical life of the electrical contact of embodiment 2.2 is enhanced by 15% with respect to that of the embodiment 2.1; electrical life of the electrical contact of embodiment 2.3 is enhanced by 58% with respect to that of the embodiment 2.1. It can be seen within the fixed mixing ratio of silver-based material, increasing the mixing ratio of stainless steel material between the stainless steel and nickel materials can improve electrical life of the electrical contact.

As testing results shown in FIG. 4, electrical life of electrical contact of comparative embodiments 2.1 and 2.6 are 11,978 times and 249 times. Comparing with that, electrical life of the electrical contact of embodiment 2.1 is enhanced by 52% with respect to that of comparative embodiment 2.1, and is enhanced by 7,214% with respect to that of comparative embodiment 2.6. Moreover, electrical life of the electrical contact of embodiment 2.2 is enhanced by 75% with respect to that of comparative embodiment 2.1, and is enhanced by 8,335% with respect to that of comparative embodiment 2.6. Furthermore, electrical life of the electrical contact of embodiment 2.3 is enhanced by 140% with respect to that of comparative embodiment 2.1, and is enhanced by 11,460% with respect to that of comparative embodiment 2.6.

The electrical contacts of embodiments 2.4 to 2.9 are formed by 90 wt % silver-based material and different mixing ratio of the stainless steel and nickel materials as shown in FIG. 3 wherein the stainless steel materials thereof are all used AISI 316L stainless steel powder. As testing results shown in FIG. 4, electrical life of the electrical contacts of embodiments 2.4 to 2.9 are 28,273 times, 25,510 times, 26,313 times, 26,026 times, 24,201 times and 27,583 times. Electrical life of electrical contact of embodiment 2.4 is the highest of embodiments 2.4 to 2.9, and the mixing ratio thereof is 9 wt % stainless steel material and 1 wt % nickel material. Electrical life of electrical contact of embodiment 2.9 is the second highest, and the mixing ratio thereof is 2.5 wt % stainless steel material and 7.5 wt % nickel material. Electrical life of electrical contact of embodiment 2.8 is the lowest of embodiments 2.4 to 2.9, and the mixing ratio thereof is 3.75 wt % stainless steel material and 6.25 wt % stainless steel material. Therefore, electrical life of the electrical contact of embodiment 2.4 which is the highest is enhanced by 136% in comparison with that of comparative embodiment 2.1. And, even the electrical contact of the embodiment 2.8 which has the lowest electrical life is enhanced by 102% with respect to that of comparative embodiment 2.1. It can be seen that comparing to the electrical contact made by pure silver material as comparative embodiment 2.1, the electrical contact of the present invention which including silver-based, stainless steel and nickel materials can improve electrical life of the electrical contact.

Referring to FIG. 4, electrical life of the electrical contact of comparative embodiment 2.2 is 16,404 times and that of comparative embodiment 2.3 is 9,890 times. Comparing with that, electrical life of the electrical contact of embodiment 2.4 which is the highest is enhanced by 72% in comparison with that of comparative embodiment 2.2. And, electrical life of the electrical contact of embodiment 2.8 which is the lowest is enhanced by 48% in comparison with that of comparative embodiment 2.2. Moreover, comparing electrical life of electrical contact of embodiment 2.4 which is the highest in these embodiments with comparative embodiment 2.3, embodiment 2.4 is enhanced by 186%. And, comparing electrical life of electrical contact of embodiment 2.8 which is the lowest in these embodiments with comparative embodiment 2.3, embodiment 2.8 is still enhanced by 145%. Therefore, within certain fixed mixing ratio of silver material, the electrical contact made of mixed stainless steel and nickel materials can improve its electrical life in comparison with the electrical contact made of silver-nickel or silver-nickel-iron materials.

Accordingly, the electrical contact of the present invention made of silver-based, stainless steel and nickel materials has better electrical life performance. And, the stainless steel material is selected from one of the group consisting of AISI 304L, AISI 316L, AISI 630 stainless steel materials and any combination thereof, wherein the AISI 316L stainless steel material includes Molybdenum (Mo) material which has high melting point characteristic and a little amount of Carbon which has characteristic of fusing resistance and reduction, and therefore strengthening temperature performance of the electrical contact. In addition, since affinity between Carbon and Chromium is large, carbides of chromium is formed and can be used to improve strength of the stainless steel to further improve hardness and wear resistance thereof.

The electrical contacts of embodiments 2.10 and 2.11 are formed by 85 wt % silver-based material and total 15 wt % of the stainless steel and nickel materials, the mixing ratio thereof is shown in FIG. 3.

The electrical contact of comparative embodiment 2.4 is made of silver powder and nickel powder with composition shown in FIG. 3 under the same manufacturing process as embodiment 1.1.

Similarly, the electrical contacts of embodiments 2.10 and 2.11 and comparative embodiment 2.4 undergo the same testing under the same conditions like embodiment 1.1, and the testing results are shown in FIG. 4.

As testing results shown in FIG. 4, electrical life of the electrical contact of embodiment 2.10 is 27,221 times and is enhanced by 6% with respect to that of the comparative embodiment 2.4 which is 25,604 times. And, electrical life of the electrical contact of embodiment 2.11 is 31,580 times, and is enhanced by 23% with respect to that of comparative embodiment 2.4.

Referring back to FIG. 3, the electrical contact of embodiment 2.12 is made of silver-based, stainless steel, nickel materials like embodiments 2.1 to 2.11; the difference is that the weight percentage of the silver-based material accounting to the composite material is 70 wt %, the weight percentage of the stainless steel material accounting to the composite material is 22.5 wt % and the weight percentage of the nickel material accounting to the composite material is 7.5 wt %.

The electrical contact of comparative embodiment 2.5 is made of silver powder and nickel powder with composition showing in FIG. 3 under the same manufacturing process as embodiment 1.1.

Similarly, the electrical contacts of embodiment 2.12 and comparative embodiment 2.5 undergo the same testing under the same conditions like embodiment 1.1, and the testing results are shown in FIG. 4.

As testing results shown in FIG. 4, electrical life of the electrical contact of embodiment 2.12 is 21,940 times and is enhanced by 15% with respect to that of the comparative embodiment 2.5 which is 19,047 times.

Accordingly, based on the comparing result between embodiments 2.10, 2.11 and comparative embodiment 2.4, and the comparing result between embodiment 2.12 and comparative embodiment 2.5, the electrical contact of the present invention which is made of composite material including silver-based material, stainless steel material and nickel material has better performance on electrical life with respect to the electrical contact made of silver and nickel materials.

The electrical contact of embodiments 2.13 and 2.14 are in rivet form made of silver-based material, stainless steel material and nickel material with the mixing ratio shown as FIG. 3 by the same manufacturing process of embodiment 1.9.

The electrical contact of comparative embodiment 2.7 is in rivet form made of silver and nickel materials by the mixing ratio shown in FIG. 3 with the same manufacturing process of embodiment 1.9.

The electrical contacts of embodiments 2.13 and 2.14 and comparative embodiment 2.7 undergo the same testing under the same conditions like embodiment 1.1, and the testing results are shown in FIG. 4.

As testing results shown in FIG. 4, electrical life of the electrical contact of embodiment 2.13 is 21,113 times and is enhanced by 399% with respect to that of the comparative embodiment 2.7 which is 4,232 times. And, electrical life of the electrical contact of embodiment 2.14 is 23,860 times, and is enhanced by 464% with respect to that of comparative embodiment 2.7.

It can be seen that the electrical contact in rivet form of the present invention which is made of the composite material including silver-based, stainless steel and nickel materials can improve the disadvantages of high arc-erosion and poor fusing resistance of the silver-nickel electrical material of the prior art since the stainless steel material of the composite material has good arc resistance and chemical stability.

Referring to FIG. 5, the electrical contact of embodiment 2.15 is another electrical contact of the present invention. The electrical contact is made of the materials by the weight percentages shown in FIG. 5 and is manufactured by the same manufacturing process like embodiment 1.1.

The electrical contact of comparative embodiment 2.8 is made of silver and stainless steel materials as shown in FIG. 5 by the same manufacturing process like embodiment 1.1.

The electrical contacts of embodiment 2.15 and comparative embodiment 2.8 are conducted the temperature rising testing under the same conditions like embodiment 1.1, and the testing results are shown in FIG. 5.

The temperature rising of electrical contact of embodiment 2.15 is 26° C. and that of comparative embodiment 2.8 is 28.95° C. Thus, the temperature rising of electrical contact of embodiment 2.15 is lower than that of comparative embodiment 2.9. In other words, the electrical contact which includes silver and stainless steel materials and further includes the nickel material has lowered temperature rising and better electrical life performance with respect to the electrical contact which only includes silver and stainless steel materials.

The electrical contacts of embodiment 2.16 to 2.18 are made of the materials according to the weight percentages shown in FIG. 5 and are manufactured by the same manufacturing process of embodiment 1.1.

The electrical contact of comparative embodiment 2.9 is made of silver and stainless steel materials as shown in FIG. 5 by the same manufacturing process like embodiment 1.1.

The electrical contacts of embodiments 2.16 to 2.18 and comparative embodiment 2.9 are conducted the temperature rising testing under the same conditions like embodiment 1.1, and the testing results are shown in FIG. 5.

The temperature rising of electrical contact of embodiment 2.16 is 40.5° C. and that of comparative embodiment 2.9 is 43.03° C. Thus, the temperature rising of electrical contact of embodiment 2.16 is lower than that of comparative embodiment 2.9. And, the temperature rising of electrical contact of embodiments 2.17 and 2.18 are 31.23° C. and 31.73° C., and both are lower than that of comparative embodiment 2.9. That is, while the weight percentage of the silver-based material of the composite material is fixed, different weight percentage and type of the stainless steel material will cause different characteristic of the electrical contact. And, the electrical contact made of the composite material having nickel material has lowered temperature rising.

The electrical contact of embodiment 2.19 is made of the silver-based, stainless steel and nickel materials according to the weight percentages as shown in FIG. 5 and is manufactured by the same manufacturing process of embodiment 1.1.

The electrical contact of comparative embodiment 2.10 is made of silver and stainless steel materials as shown in FIG. 5 by the same manufacturing process like embodiment 1.1.

The electrical contact of embodiment 2.19 and comparative embodiment 2.10 are conducted the same temperature rising testing under the same conditions like embodiment 1.1, and the testing results are shown in FIG. 5.

The temperature rising of electrical contact of embodiment 2.19 is 37.2° C. and that of comparative embodiment 2.10 is 49.23° C. Thus, the temperature rising of electrical contact of embodiment 2.19 is lower than that of comparative embodiment 2.10. That is, the electrical contact which includes silver and stainless steel materials and further includes the nickel material has lowered temperature rising with respect to the electrical contact which only includes silver and stainless steel materials.

The rivet form electrical contacts of embodiments 2.20 and 2.21 are made of the silver-based, stainless steel and nickel materials according to the weight percentages as shown in FIG. 5 and are manufactured by the same manufacturing process of embodiment 1.9.

The electrical contact of comparative embodiment 2.11 is made of silver and stainless steel materials as shown in FIG. 5 by the same manufacturing process like embodiment 1.9.

The electrical contacts of embodiments 2.20, 2.21 and comparative embodiment 2.11 are conducted the same temperature rising testing under the same conditions like embodiment 1.1, and the testing results are shown in FIG. 5.

The temperature rising of electrical contact of embodiment 2.20 is 32.3° C. and that of comparative embodiment 2.11 is 35.73° C. Thus, the temperature rising of electrical contact of embodiment 2.20 is lower than that of comparative embodiment 2.11. And, the temperature rising of electrical contact of embodiment 2.21 is 32.55° C. and is lower than that of comparative embodiment 2.11. Accordingly, the electrical contact made of the composite material which is added the nickel material has lowered temperature rising.

Accordingly to the testing results shown in FIG. 5, the electrical contacts of embodiments 2.15 to 2.21 which is made of the composite material including the nickel material has lowered temperature rising in comparison of the electrical contacts of comparative embodiments which only made of silver and stainless steel materials. Therefore, the electrical contact of the present invention has better electrical contacting performance and electrical life.

FIG. 6 shows the metallographic structure (magnification: 100×) of a composite material of the electrical contact of the present invention. The composite material includes a silver-based material 1 and a stainless steel material 2 evenly dispersed in the silver-based material 1.

Figure 7:
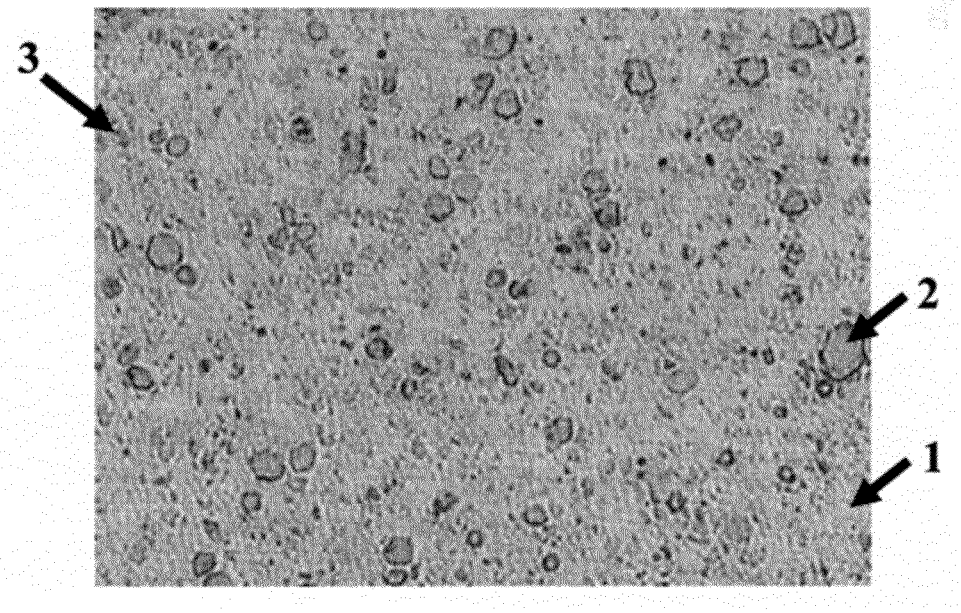
FIG. 7 a metallographic structure (magnification: 100×) of a composite material of the electrical contact of the present invention, wherein the composite material includes a silver-based material, a stainless steel material and a nickel material.

FIG. 7 shows the metallographic structure (magnification: 100×) of another composite material of the electrical contact of the present invention. The composite material includes a silver-based material 1, a stainless steel material 2 and further includes a nickel material 3, wherein the stainless steel and the nickel materials are both evenly dispersed in the silver-based material 1.

With the invention, the electrical contact which is made of the composite material including the silver-based and stainless steel materials, whether in tip form or rivet form, its electrical life is obviously enhanced comparing to the prior art electrical contact made of pure silver material, pure stainless steel material, silver-nickel or silver-iron. And the electrical contact of the present invention further has better fusing resistance, better wear resistance, lower contact resistance and higher chemical stability, and therefore can avoid performance deterioration caused by prolonged operation of the switch.

And, another electrical contact of the present invention which is made of another composite material including silver-based, stainless steel and further nickel materials (wherein the weight percentage of the stainless steel material is 0.01% to 35% and the weight percentage of the nickel material is 0.01% to 35%), whether in tip form or rivet form, has better electrical life which is up to hundred times more than that of the electrical contact of prior art which is made of pure silver material, pure stainless steel material, silver-nickel material and silver-iron material. Moreover, the electrical contact including the nickel material has lowered temperature rising than the electrical contact which includes silver and stainless steel materials. Accordingly, the electrical contact of the present invention not only has enhanced electrical life but also has lowered temperature rising. And, the electrical contact of the present invention similarly has better fusing resistance, better wear resistance, lower contact resistance and higher chemical stability performances, and therefore can avoid performance deterioration caused by prolonged operation of the switch.

The foregoing description of the embodiments of the invention has been presented for the purposes of illustration and description. It is not intended to be exhaustive or to limit the invention to the precise forms or methods disclosed. Persons skilled in the relevant art can appreciate that many modifications and variations are possible in light of the above teachings.

The invention claimed is:

1. An electrical contact comprising silver-based material and stainless steel material, wherein the stainless steel material is dispersed in the silver-based material and the weight percentage thereof accounting to the electrical contact is 0.01% to 35%.

2. The electrical contact of claim 1, wherein the weight percentage of the stainless steel material accounting to the electrical contact is 0.01% to 30%.

3. The electrical contact of claim 2, wherein the stainless steel material is selected from one of the group consisting of ferrite, austenite, martensite or any combination thereof.

4. The electrical contact of claim 1, wherein the stainless steel material is selected from one of the group consisting of ferrite, austenite, martensite or any combination thereof.

5. The electrical contact of claim 1 further comprising nickel material, wherein the nickel material is dispersed in the silver-based material and the weight percentage of the nickel material in the electrical contact is from 0.01% to 35%.

6. The electrical contact of claim 5, wherein the weight percentage of the stainless steel material accounting to the electrical contact is 0.01% to 30%.

7. The electrical contact of claim 6, wherein the stainless steel material is selected from one of the group consisting of ferrite, austenite, martensite or any combination thereof.

8. The electrical contact of claim 5, wherein the stainless steel material is selected from one of the group consisting of ferrite, austenite, martensite and any combination thereof.

* * * * *